US009577333B2

(12) United States Patent
Tseng et al.

(10) Patent No.: US 9,577,333 B2
(45) Date of Patent: Feb. 21, 2017

(54) ANTENNA STRUCTURE AND WIRELESS COMMUNICATION DEVICE USING SAME

(71) Applicant: Chiun Mai Communication Systems, Inc., New Taipei (TW)

(72) Inventors: Yen-Jung Tseng, New Taipei (TW); Yi-Ting Chen, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 114 days.

(21) Appl. No.: 14/584,900

(22) Filed: Dec. 29, 2014

(65) Prior Publication Data

US 2016/0087340 A1 Mar. 24, 2016

(30) Foreign Application Priority Data

Sep. 19, 2014 (CN) ..... 2014 1 0480631

(51) Int. Cl.

| | |
|---|---|
| ***H01Q 1/24*** | (2006.01) |
| ***H01Q 7/00*** | (2006.01) |
| ***H01Q 1/48*** | (2006.01) |
| ***H01Q 9/42*** | (2006.01) |

(52) U.S. Cl.
CPC ..... *H01Q 7/00* (2013.01); *H01Q 1/243* (2013.01); *H01Q 1/48* (2013.01); *H01Q 9/42* (2013.01)

(58) Field of Classification Search
CPC ..... H01Q 1/24; H01Q 1/243; H01Q 1/48; H01Q 7/00
USPC ..... 343/702, 866
See application file for complete search history.

(56) References Cited

U.S. PATENT DOCUMENTS

2014/0292584 A1* 10/2014 Lin ..... H01Q 1/243 343/700 MS

FOREIGN PATENT DOCUMENTS

| | | |
|---|---|---|
| TW | I378599 B1 | 12/2012 |
| TW | 201312850 A1 | 3/2013 |

* cited by examiner

*Primary Examiner* — Hoang V Nguyen
(74) *Attorney, Agent, or Firm* — Zhigang Ma

(57) ABSTRACT

An antenna structure includes a feed portion, a ground portion, at least one metallic portion, and a radiating portion. The ground portion is spaced apart from the feed portion. The least one metallic portion is electrically connected to the ground portion. The radiating portion has a first end electrically connected to the feed portion and a second end electrically connected to the at least one metallic portion.

17 Claims, 4 Drawing Sheets

ANTENNA STRUCTURE AND WIRELESS COMMUNICATION DEVICE USING SAME

CROSS-REFERENCE TO RELATED APPLICATIONS

This application claims priority to Chinese Patent Application No. 201410480631.8 filed on Sep. 19, 2014, the contents of which are incorporated by reference herein.

FIELD

The subject matter herein generally relates to an antenna structure and a wireless communication device using the antenna structure.

BACKGROUND

Antennas are important elements of wireless communication devices, such as mobile phones or personal digital assistants. Many wireless communication devices further employ metal housings for improving heat dissipation or other purposes.

BRIEF DESCRIPTION OF THE DRAWINGS

Implementations of the present technology will now be described, by way of example only, with reference to the attached figures.

DETAILED DESCRIPTION

Figure 1:
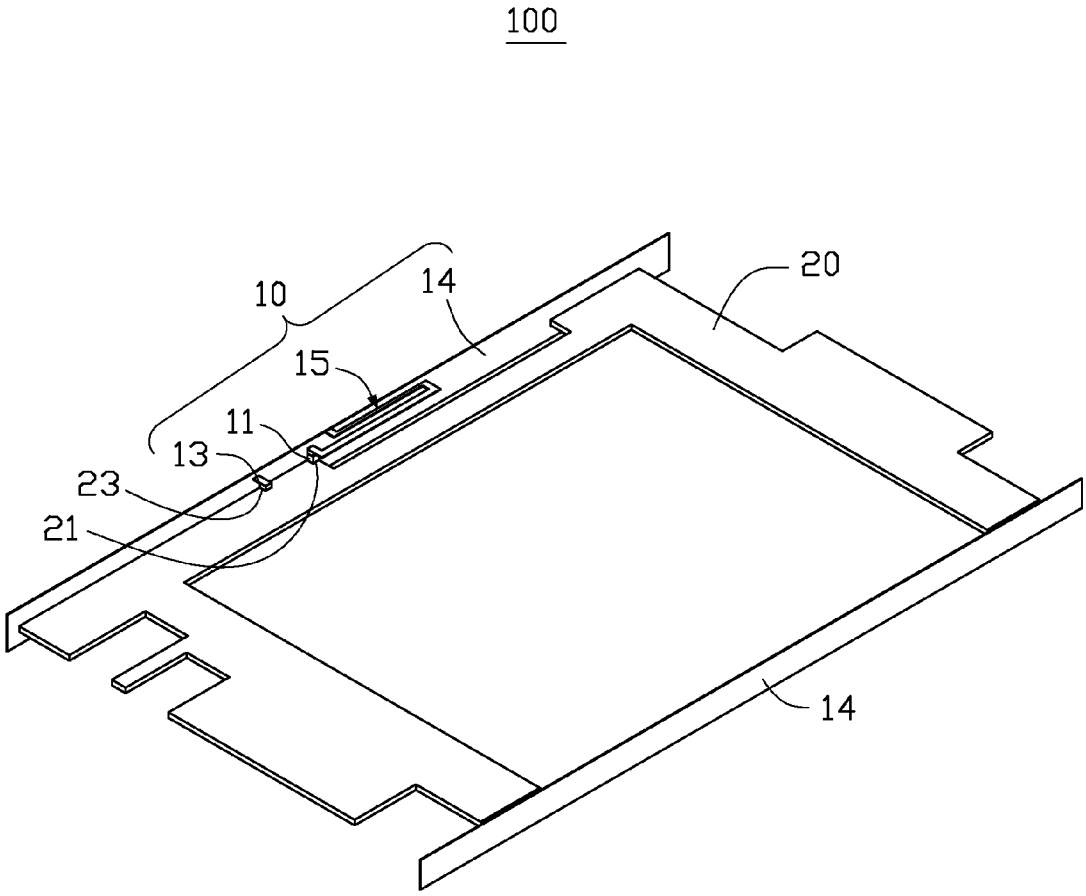
FIG. 1 is an isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of an antenna structure 10. The antenna structure 10 is used in a wireless communication device 100. The wireless communication device 100 can be a mobile phone or a personal digital assistant, for example. The wireless communication device 100 further includes a baseboard 20. The baseboard 20 can be a printed circuit board (PCB) of the wireless communication device 100. The baseboard 20 includes a feed point 21 and a ground point 23. The feed point 21 and the ground point 23 are both positioned on the baseboard 20 and are spaced apart from each other.

The antenna structure 10 includes a feed portion 11, a ground portion 13, at least one metallic portion 14, and a radiating portion 15. The feed portion 11 is electrically connected to the feed point 21 of the baseboard 20 and is configured to feed current to the antenna structure 10. The ground portion 13 is electrically connected to the ground point 23 of the baseboard 20 and is configured to ground the antenna structure 10.

In this embodiment, there are two metallic portions 14. The metallic portions 14 can be both a portion of a metallic housing of the wireless communication device 100, or can be a decorative metallic strip of the wireless communication device 100. The metallic portions 14 are substantially rectangular sheets and are perpendicularly located at two opposite edges of the baseboard 20. The two metallic portions 14 are parallel to each other.

A first end of the radiating portion 15 is electrically connected to the feed portion 11. A second end of the radiating portion 15 is electrically connected to one of the metallic portions 14. The metallic portion 14 connected to the radiating portion 15 is further electrically connected to the ground portion 13. Then, the feed portion 11, the radiating portion 15, the metallic portion 14, and the ground portion 13 cooperatively form a loop antenna.

Figure 2:
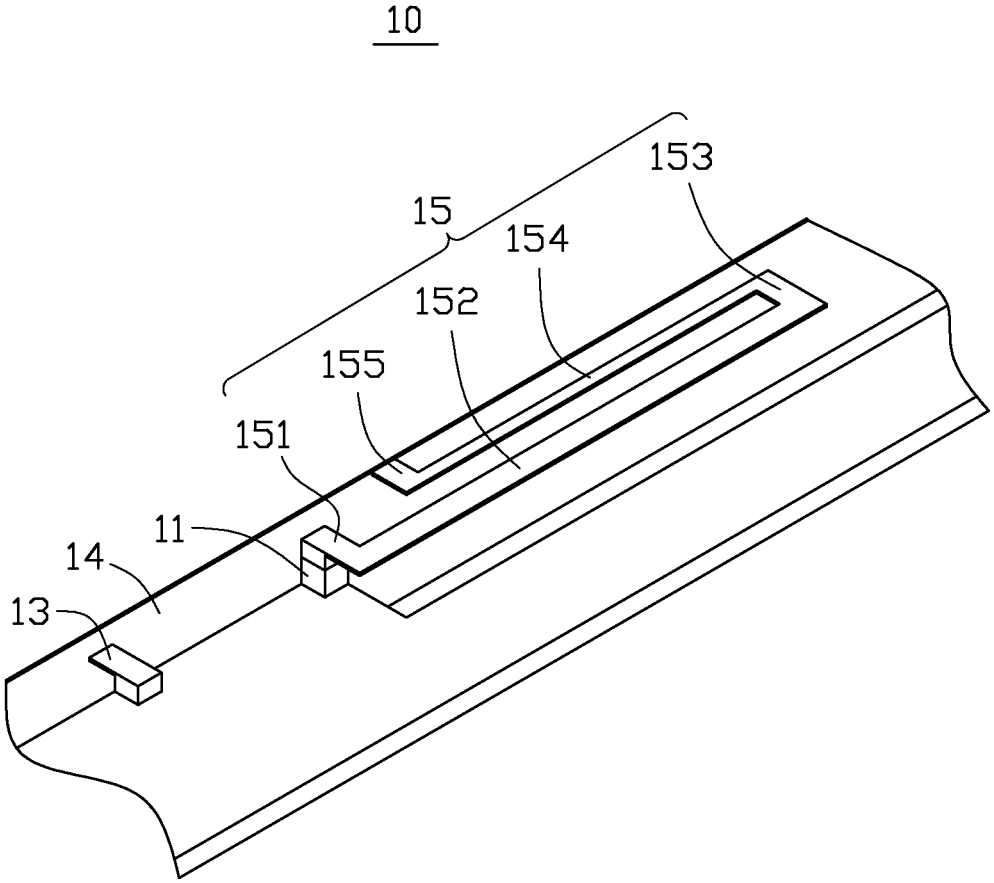
FIG. 2 is an isometric view of the antenna structure of the wireless communication device of FIG. 1.

FIG. 2 illustrates that the radiating portion 15 includes a first connecting section 151, a first radiating section 152, a second radiating section 153, a third radiating section 154, and a second connecting section 155. In this embodiment, the first connecting section 151, the first radiating section 152, the second radiating section 153, the third radiating section 154, and the second connecting section 155 are connected in order and are positioned at a plane parallel to a plane that the baseboard 20 is positioned.

The first connecting section 151 is electrically connected to the feed portion 11 and is configured to feed current to the radiating portion 15. The first radiating section 152 is substantially a strip. The first radiating section 152 is perpendicularly connected to one end of the first connecting section 151 and extends along a direction away from the ground portion 13. The first radiating section 152 is parallel to the metallic portions 14. The second radiating section 153 is perpendicularly connected to one end of the first radiating section 152 away from the feed portion 11 and extends towards the metallic portion 14 connected to the ground portion 13. The second radiating section 153 is parallel to the first connecting section 151 and forms a U-shaped structure with the first connecting section 151 and the first radiating section 512.

The third radiating section 154 is substantially a rectangular sheet. The third radiating section 154 is perpendicularly connected to one end of the second radiating section 153 away from the first radiating section 152 and extends towards the feed portion 11. In this embodiment, the third radiating section 154 is parallel to the first radiating section 152 and a length of the third radiating section 154 is less than a length of the first radiating section 152. The second connecting section 155 is located between and is spaced apart from the first connecting section 151 and the second radiating section 153. The second connecting section 155 is perpendicularly connected between one end of the third radiating section 154 away from the third radiating section 154 and the metallic portion 14 connected to the ground portion 13.

When current is input to the feed portion 11, the current flows to the radiating portion 15 and the metallic portion 14, and is grounded through the ground portion 13 to form a current path for receiving/sending wireless signals at frequencies of about 2.4 GHz to about 2.484 GHz. Then, the antenna structure 10 can be used in common wireless communication systems, such as Bluetooth and WIFI, with exceptional communication quality.

Figure 3:
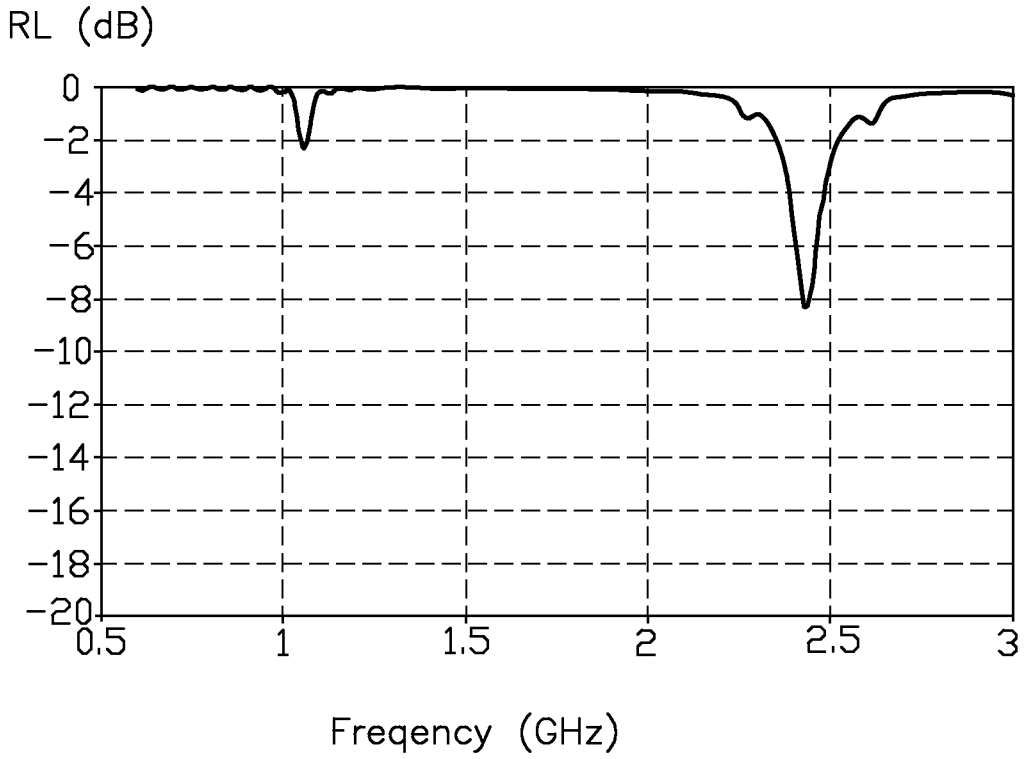
FIG. 3 is a return loss (RL) graph of the antenna structure of the wireless communication device of FIG. 1.

FIG. 3 is a measurement diagram of return loss (RL) of the antenna structure 10. When the antenna structure 10 receives/sends wireless signals at frequencies of about 2.4 GHz to about 2.484 GHz, the RL of the antenna structure 10 is less than −6 dB, and satisfies communication standards.

Figure 4:
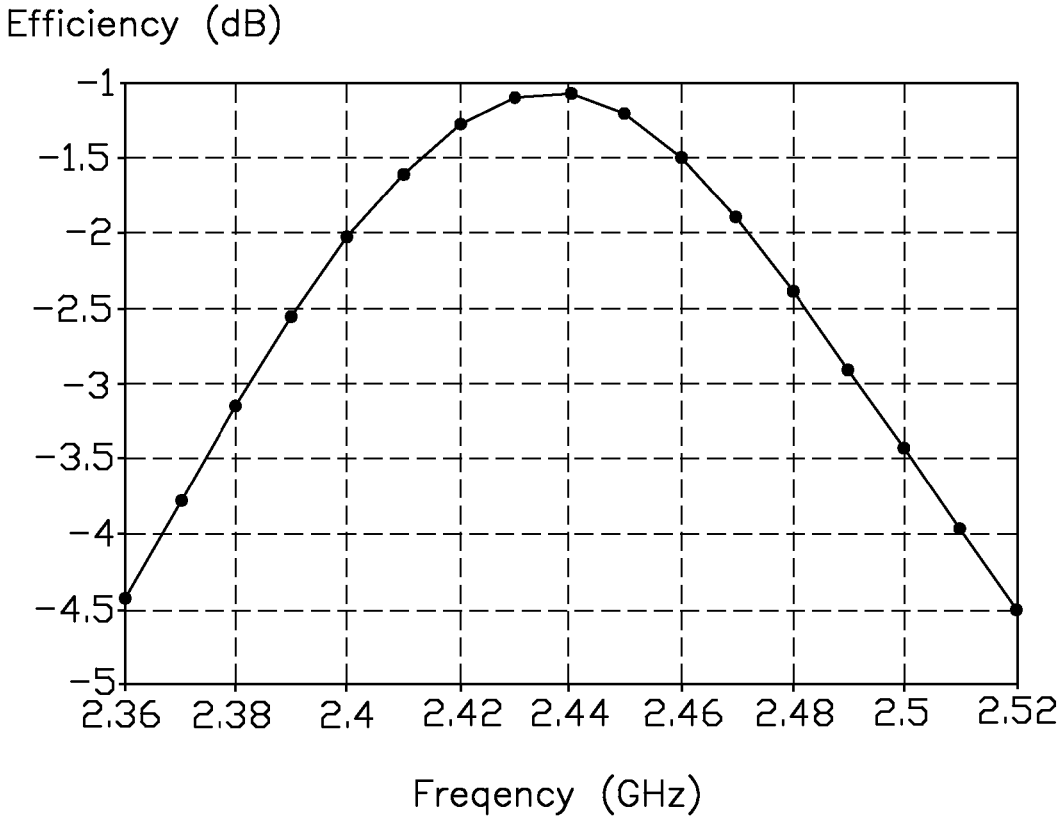
FIG. 4 is a radiating efficiency measurement of the antenna structure of the wireless communication device of FIG. 1.

FIG. 4 illustrates a radiating efficiency measurement of the antenna structure 10. The radiating efficiency of the antenna structure 10 is acceptable when operates at frequencies of about 2.4 GHz to about 2.484 GHz and satisfies radiation requirements.

In other embodiments, by adjusting a shape and/or a size of the radiating portion 15, or a position of the metallic portion 14 connected to the ground portion 13, the antenna structure 10 can further receive/send wireless signals at a frequency of about 1.575 GHz (GPS).

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

a feed portion;

a ground portion spaced apart from the feed portion;

at least one metallic portion electrically connected to the ground portion; and a radiating portion having a first end electrically connected to the feed portion and a second end electrically connected to the at least one metallic portion;

wherein the radiating portion comprises a first connecting section, a first radiating section, a second radiating section, a third radiating section, and a second connecting section connected in order, the first radiating section is perpendicularly connected to one end of the first connecting section and extends along a direction away from the ground portion, the second radiating section is perpendicularly connected to one end of the first radiating section away from the feed portion and extends towards the metallic portion connected to the ground portion so as to form a U-shaped structure with the first connecting section and the first radiating section.

2. The antenna structure of claim 1, wherein the first connecting section is electrically connected to the feed portion, and the second connecting section is electrically connected to the at least one metallic portion.

3. The antenna structure of claim 1, wherein the first connecting section, the first radiating section, the second radiating section, the third radiating section, and the second connecting section are positioned at a same plane.

4. The antenna structure of claim 1, wherein the first radiating section is parallel to the metallic portion connected to the ground portion and the second radiating section is parallel to the first connecting section.

5. The antenna structure of claim 1, wherein the third radiating section is perpendicularly connected to one end of the second radiating section away from the first radiating section and extends towards the feed portion; the second connecting section is perpendicularly connected between one end of the third radiating section away from the third radiating section and the metallic portion connected to the ground portion.

6. The antenna structure of claim 5, wherein the third radiating section is parallel to the first radiating section and a length of the third radiating section is less than a length of the first radiating section.

7. A wireless communication device comprising:

a baseboard forming a feed point and a ground point; and an antenna structure, the antenna structure comprising:

a feed portion electrically connected to the feed point;

a ground portion spaced apart from the feed portion and electrically connected to the ground point;

at least one metallic portion electrically connected to the ground portion; and a radiating portion having a first end electrically connected to the feed portion and a second end electrically connected to the at least one metallic portion, wherein the radiating portion comprises a first connecting section, a first radiating section, a second radiating section, a third radiating section, and a second connecting section connected in order, the first radiating section is perpendicularly connected to one end of the first connecting section and extends along a direction away from the ground portion, the second radiating section is perpendicularly connected to one end of the first radiating section away from the feed portion and extends towards the metallic portion connected to the ground portion so as to form a U-shaped structure with the first connecting section and the first radiating section.

8. The wireless communication device of claim 7, wherein the at least one metallic portion is a portion of a metallic housing of the wireless communication device.

9. The wireless communication device of claim 7, wherein the first connecting section is electrically connected to the feed portion, and the second connecting section is electrically connected to the at least one metallic portion.

10. The wireless communication device of claim 7, wherein the first connecting section, the first radiating section, the second radiating section, the third radiating section, and the second connecting section are positioned at a same plane.

11. The wireless communication device of claim 7, wherein the first radiating section is parallel to the metallic portions and the second radiating section is parallel to the first connecting section.

12. The wireless communication device of claim 7, wherein the third radiating section is perpendicularly connected to an end of the second radiating section away from the first radiating section and extends towards the feed portion; the second connecting section is perpendicularly connected between an end of the third radiating section away from the third radiating section and the metallic portion connected to the ground portion.

13. The wireless communication device of claim 12, wherein the third radiating section is parallel to the first radiating section and a length of the third radiating section is less than a length of the first radiating section.

14. A wireless communication device comprising:

a baseboard forming a feed point and a ground point;

a metallic housing positioned at edges of the baseboard; and an antenna structure, the antenna structure comprising:

a feed portion electrically connected to the feed point;

a ground portion spaced apart from the feed portion, the ground portion electrically connected to the ground point and the metallic housing; and a radiating portion having a first end electrically connected to the feed portion and a second end electrically connected to the metallic housing;

wherein the radiating portion comprises a first connecting section, a first radiating section, a second radiating section, a third radiating section, and a second connecting section connected in order, the first radiating section is perpendicularly connected to one end of the first connecting section and extends along a direction away from the ground portion, the second radiating section is perpendicularly connected to one end of the first radiating section away from the feed portion and extends towards the metallic portion connected to the ground portion so as to form a U-shaped structure with the first connecting section and the first radiating section.

15. The wireless communication device of claim 14, wherein the first connecting section is electrically connected to the feed portion, and the second connecting section is electrically connected to the metallic housing.

16. The wireless communication device of claim 14, wherein the third radiating section is perpendicularly connected to an end of the second radiating section away from the first radiating section and extends towards the feed portion; the second connecting section is perpendicularly connected between an end of the third radiating section away from the third radiating section and the metallic housing.

17. The wireless communication device of claim 16, wherein the third radiating section is parallel to the first radiating section and a length of the third radiating section is less than a length of the first radiating section.

* * * * *